US012618607B2

(12) United States Patent
Dong et al.

(10) Patent No.: US 12,618,607 B2
(45) Date of Patent: May 5, 2026

(54) REFRIGERATOR HAVING INCLINED DRAIN PIPE DISPOSED AT LOWER PORTION OF REFRIGERATOR

(71) Applicants: QINGDAO HAIER REFRIGERATOR CO., LTD., Qingdao (CN); HAIER SMART HOME CO., LTD., Qingdao (CN)

(72) Inventors: Lingyun Dong, Qingdao (CN); Bin Fei, Qingdao (CN); Changzhi Wang, Qingdao (CN); Jianquan Chen, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 69 days.

(21) Appl. No.: 18/702,234

(22) PCT Filed: Jul. 28, 2022

(86) PCT No.: PCT/CN2022/108725
§ 371 (c)(1),
(2) Date: Apr. 17, 2024

(87) PCT Pub. No.: WO2023/065762
PCT Pub. Date: Apr. 27, 2023

(65) Prior Publication Data

US 2024/0410638 A1 Dec. 12, 2024

(30) Foreign Application Priority Data

Oct. 18, 2021 (CN) ..... 202111211445.0

(51) Int. Cl.
*F25D 21/14* (2006.01)
*F25D 23/00* (2006.01)

(52) U.S. Cl.
CPC ..... *F25D 21/14* (2013.01); *F25D 23/003* (2013.01)

(58) Field of Classification Search
CPC .. F25D 21/14; F25D 23/003; F25D 2321/146; F25D 2321/143
See application file for complete search history.

(56) References Cited

U.S. PATENT DOCUMENTS 5,499,514 A 3/1996 Ho

FOREIGN PATENT DOCUMENTS

CN 208817767 U 5/2019
CN 208817799 U 5/2019
(Continued)

OTHER PUBLICATIONS

Machine English translation of WO2021/047552 to Zhu et al. translated Aug. 2025 (Year: 2021).*
(Continued)

*Primary Examiner* — Cassey D Bauer
(74) *Attorney, Agent, or Firm* — MUNCY, GEISSLER, OLDS & LOWE, P.C.

(57) ABSTRACT

A refrigerator having an inclined drain pipe disposed at a lower portion of the refrigerator comprises: a cabinet; a storage chamber, a refrigeration cavity, a heat dissipation machine compartment, and a front wall of the heat dissipation machine compartment extends obliquely upwards from front to back from the middle of a cabinet bottom plate; an evaporation dish; a drain pipe extends obliquely downwards from front to back from the bottom of the refrigeration cavity, passes through the front wall of the heat dissipation machine compartment and then further extends to the evaporation dish; a water pipe securing member is arranged at the position where the drain pipe passes through the front wall; the water pipe securing member has a first securing face, and
(Continued)

the first securing face is abutting the front wall of the heat dissipation machine compartment.

11 Claims, 9 Drawing Sheets

(56) References Cited

FOREIGN PATENT DOCUMENTS

| | | | |
|---|---|---|---|
| CN | 110375473 | A | 10/2019 |
| CN | 210832692 | U | 6/2020 |
| CN | 113074502 | A | 7/2021 |
| CN | 216557840 | U | 5/2022 |
| JP | 52-30630 | | 10/1970 |
| JP | 2017207192 | A | 11/2017 |
| WO | WO2020173359 | A1 | 9/2020 |
| WO | WO2021047552 | A1 | 3/2021 |

OTHER PUBLICATIONS

Machine English language translation to Wang et al. Translated Aug. 2025 (Year: 2020).*

* cited by examiner

REFRIGERATOR HAVING INCLINED DRAIN PIPE DISPOSED AT LOWER PORTION OF REFRIGERATOR

CROSS-REFERENCE TO RELATED APPLICATIONS

The present application is a national phase entry of International Application No. PCT/CN2022/108725, filed Jul. 28, 2022, which claims priority to Chinese Patent Application No. 202111211445.0, filed Oct. 18, 2021, which are incorporated herein by reference in their entirety.

TECHNICAL FIELD

The present application belongs to the technical field of refrigeration equipment technology, and more particularly relates to a refrigerator having an inclined drain pipe disposed at a lower portion of the refrigerator.

BACKGROUND

In a refrigerator with a bottom-placed evaporator, the evaporator is located in a cooling chamber at a bottom side of a storage chamber, thereby elevating the storage chamber to facilitate user access to stored items at the bottom side.

A heat dissipation compartment of the refrigerator is situated at a rear bottom part of the refrigerator, i.e., below and behind the cooling chamber, to expand a heat dissipation space as much as possible. A front wall of the heat dissipation compartment (also known as the refrigerator's bottom steel plate) is generally inclined.

A drain pipe drains from a bottom portion of the cooling chamber to an evaporation dish in the heat dissipation compartment. A relative positioning of the cooling chamber and the heat dissipation compartment reduces the drainage angle of the drain pipe. Compared to traditional refrigerators where the drain pipe vertically penetrates the bottom steel plate, the drain pipe of the refrigerator with the bottom-placed evaporator forms an acute angle with the bottom steel plate, thereby making it difficult to secure and prone to gaps. When foaming between the cooling chamber and the heat dissipation compartment, foaming material may easily overflow into the heat dissipation compartment through a penetration point. Additionally, due to the small drainage angle, the penetration point is prone to drainage blockages.

Reference to any prior art in the specification is not, and should not be taken as, an acknowledgment or any form of suggestion that this prior art forms part of the common general knowledge in Europe or any other jurisdiction or that this prior art could reasonably be expected to be understood and regarded as relevant by a person skilled in the art.

SUMMARY

An object of the present application is to provide a refrigerator having an inclined drain pipe disposed at a lower portion of the refrigerator that overcomes or at least partially solves aforementioned problems.

A further object of the present application is to reduce the difficulty of securing the drain pipe as it enters the heat dissipation machine compartment.

A further aim is to prevent overflow at the penetration point of the drain pipe.

In particular, the present application is directed to a refrigerator having an inclined drain pipe disposed at a lower portion of the refrigerator, comprising:

a cabinet, defining a storage chamber therein, a refrigeration cavity for arranging an evaporator formed in a bottom portion of the storage chamber, and the cabinet having a heat dissipation machine compartment at a rear bottom portion of the refrigeration cavity, a front wall of the heat dissipation machine compartment extending from a middle of a bottom plate of the cabinet obliquely upwards along a front-to-back direction;

an evaporation dish, arranged in the heat dissipation machine compartment;

a drain pipe, extending obliquely downwards from a bottom portion of the refrigeration cavity along the front-to-back direction, passing through the front wall of the heat dissipation machine compartment and further extending to the evaporation dish, thereby draining defrost water from the refrigeration cavity to the evaporation dish;

a water pipe securing member, arranged at a position where the drain pipe passes through the front wall, and used for securing the drain pipe, the water pipe securing member having a first securing face, which is used to abut the front wall of the heat dissipation machine compartment.

Further, the front wall of the heat dissipation machine compartment has a front wall through-hole where the drain pipe passes through, a shape of the front wall through-hole is consistent with a cross-sectional shape of the drain pipe on a plane where the front wall of the heat dissipation machine compartment is located; and the water pipe securing member has a perforating hole for the drain pipe to pass through, a shape of an opening of the perforating hole formed on the first securing face is consistent with that of the front wall through-hole.

Further, the water pipe securing member has a second fixing surface on a side opposite to the first securing face, the second fixing surface is perpendicular to an axial direction of the drain pipe, thereby making a shape of an opening of the perforating hole formed on the second fixing surface consistent with a cross-section of the drain pipe.

Further, the drain pipe comprises:

a first section, one end of the first section is connected to the bottom portion of the refrigeration cavity, the other end of the first section passes through the perforating hole and defines a connecting structure on an outer perimeter thereof;

a second section, connected to the other end of the first section and extending to the evaporation dish.

Further, the connecting structure comprises a threaded structure, and the refrigerator further comprises a fixing nut, the fixing nut is detachably connected to the threaded structure, an end of the fixing nut is abutting against the second fixing surface, to secure the drain pipe and the water pipe securing member.

Further, the first section is a rigid tube; at least a part of the second section is a corrugated tube; and/or an inclination angle of the drain pipe is greater than or equal to 5 degrees.

Further, the first section defines at least one positioning rib along the axial direction on a radial outer circumference of a segment through the perforating hole;

the perforating hole forms a positioning slot on the radial outer circumference that matches the positioning rib, to limit the position of the first section through the combination of the positioning rib and the positioning slot.

Further, an opening of the perforating hole formed on the first securing face is located in the middle of the first securing face; the first securing face has spaces around the opening that abut the front wall of the heat dissipation machine compartment.

Further, the front wall of the heat dissipation machine compartment defines a protrusion in an area corresponding to the water pipe securing member; and the water pipe securing member is embedded in a recess behind the protrusion.

Further, the refrigerator further comprising:

an air duct component, arranged at a middle area of the heat dissipation machine compartment along a transverse direction, dividing the heat dissipation machine compartment along the transverse direction of the cabinet into a first heat dissipation chamber and a second heat dissipation chamber, the air duct component has a heat dissipation fan mounted on a side facing towards the first heat dissipation chamber, and a condenser mounted on a side facing towards the second heat dissipation chamber;

a compressor, installed in the first heat dissipation chamber;

the evaporation dish installed in the second heat dissipation chamber.

Based on the description above, it is understandable to those skilled in the art that in the technical solution of this application, the evaporation dish is arranged within the beat dissipation machine compartment, and the drain pipe is set from the front to the back and downwards from the bottom portion of the refrigeration cavity, extending further to the evaporation dish after passing through the front wall of the heat dissipation machine compartment. An acute angle is formed between the drain pipe and a plane where the front wall of the heat dissipation machine compartment is located. The first securing face of the water pipe securing member abuts against the front wall of the heat dissipation machine compartment, using the water pipe securing member to secure the drain pipe. The first securing face can prevent foaming overflow and enhance connection reliability.

Moreover, the application's solution comprises the water pipe securing member with the second fixing surface opposite to the first securing face, perpendicular to the axial direction of the drain pipe, making the shape of the opening of the perforating hole formed on the second fixing surface consistent with the cross-section of the drain pipe, facilitating the comprehensive abutment of locking nuts or other fasteners to the second fixing surface, thus improving connection reliability and ease of operation.

Further still, by improving the fit between the front wall of the heat dissipation machine compartment, the water pipe securing member, and others, the application ensures reliable fixation of the drain pipe, reducing faults caused by drainage.

The above and other objects, advantages and features of the present application will become more apparent to those skilled in the art from the following detailed description of specific embodiments thereof taken in conjunction with the accompanying drawings.

As used herein, except where the context clearly requires otherwise, the term "comprise" and variations of the term, such as "comprising", "comprises" and "comprised", are not intended to exclude further features, components, integers or steps.

BRIEF DESCRIPTION OF THE DRAWINGS

Some specific embodiments of the application will be described in detail hereinafter by way of example and not by way of limitation with reference to the accompanying drawings. The same reference numerals identify the same or similar components or parts in the drawings. Those skilled in the art should appreciate that the drawings are not necessarily drawn to scale. In the drawings.

DETAILED DESCRIPTION OF EMBODIMENTS

Figure 1:
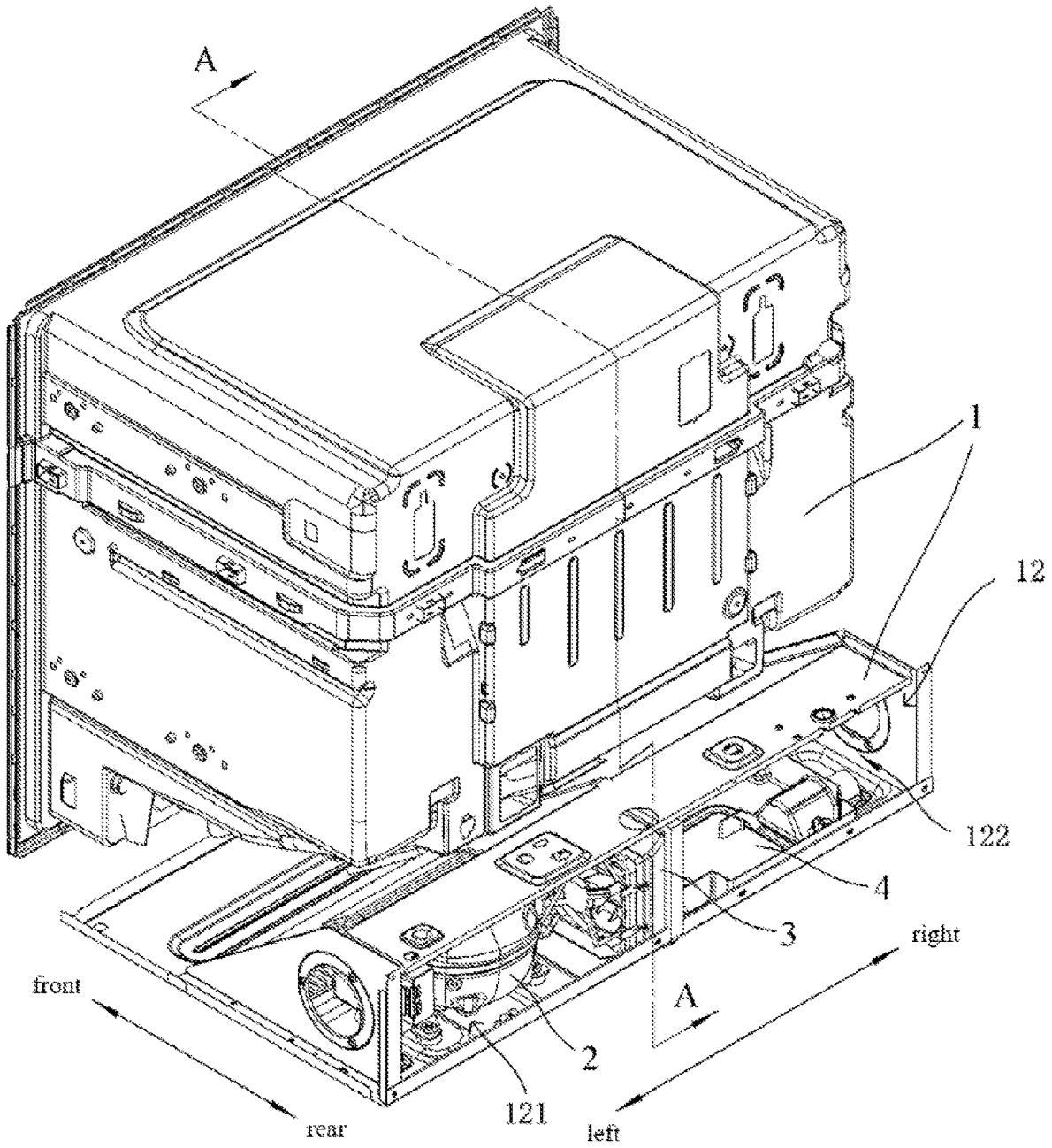
FIG. 1 is a rear upper isometric view of a bottom part structure of a refrigerator having an inclined drain pipe disposed at a lower portion of the refrigerator according to some embodiments of the application.

Those skilled in the art should understand that the embodiments described below are only a part of embodiments of the present application rather than all embodiments of the present application. This part of embodiments is intended to explain the technical principle of the present application rather than to restrict the protection scope thereof. All other embodiments achieved by those of ordinary skills in the art, based on the embodiments of the present application without creative work, shall fall within the protection scope of the present application.

In the description of the present application, it should be understood that, orientation or position relationships indicated by the terms "center", "upper", "lower", "top", "bottom", "left", "right", "vertical", "horizontal", "inner", "outer" etc. are based on the orientation or position relationships shown in the drawings, for ease of the description of the present application rather than indicating or implying that the indicated device or element must have a particular orientation or be constructed and operated in a particular orientation. Therefore, these terms should not be understood as limitations to the present application. In addition, the terms such as "first", "second" and "third" are merely for a descriptive purpose, and cannot be understood as indicating or implying relative importance.

Further, in the description of the present application, unless otherwise explicitly defined or limited, the terms "install", "connected with", "connected to" should be comprehended in a broad sense. For example, they may refer to a fixed connection, detachable connection or integrated connection, or may be a mechanical connection or electrical connection, or may refer to a direct connection or an indirect connection via an intermediary, or may be an internal communication of two elements. The specific meanings about the foregoing terms in the present application may be understood by those skilled in the art according to specific circumstances.

Figure 2:
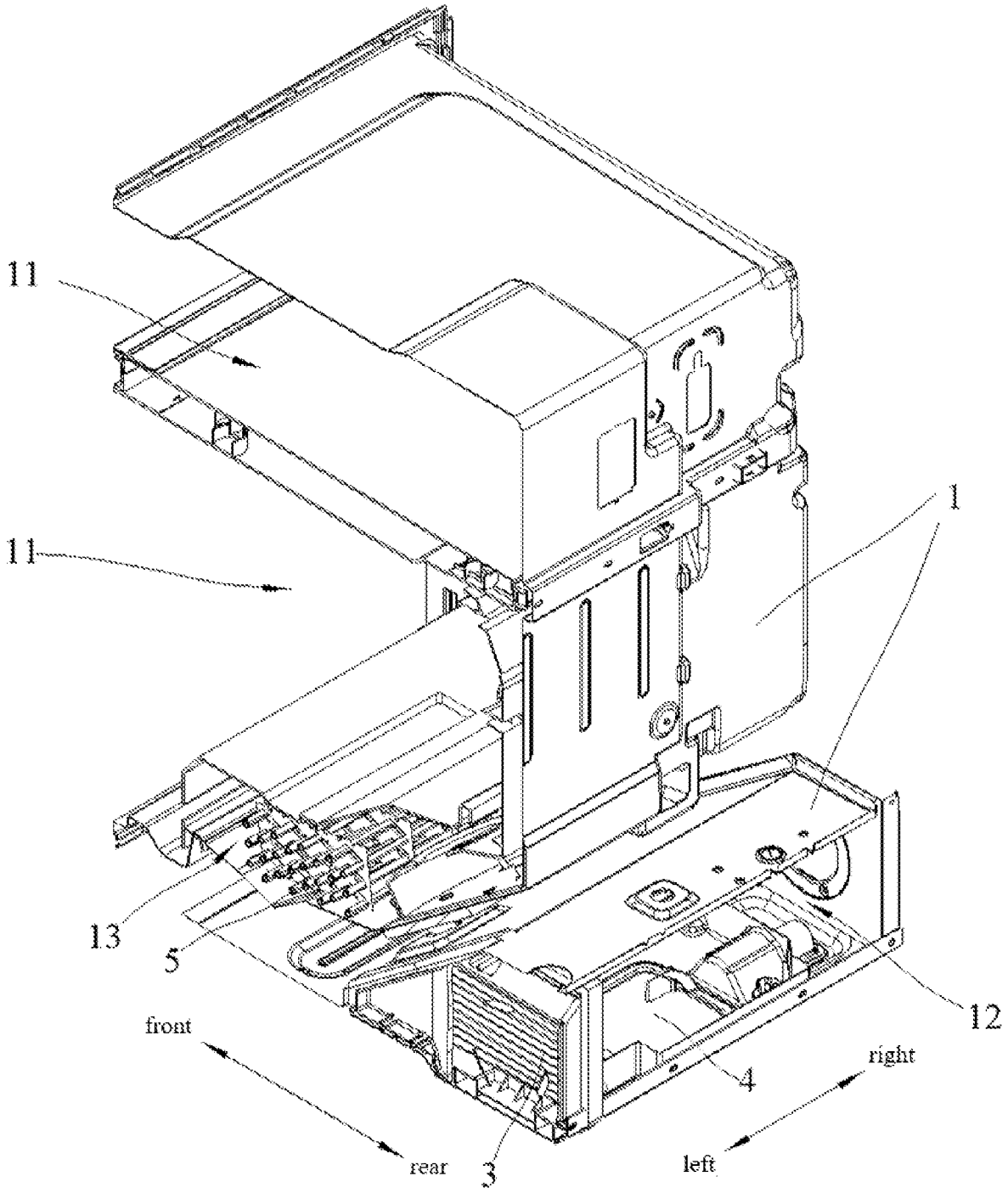
FIG. 2 is a sectional view of the bottom part structure taken along line A-A in FIG. 1.
Figure 3:
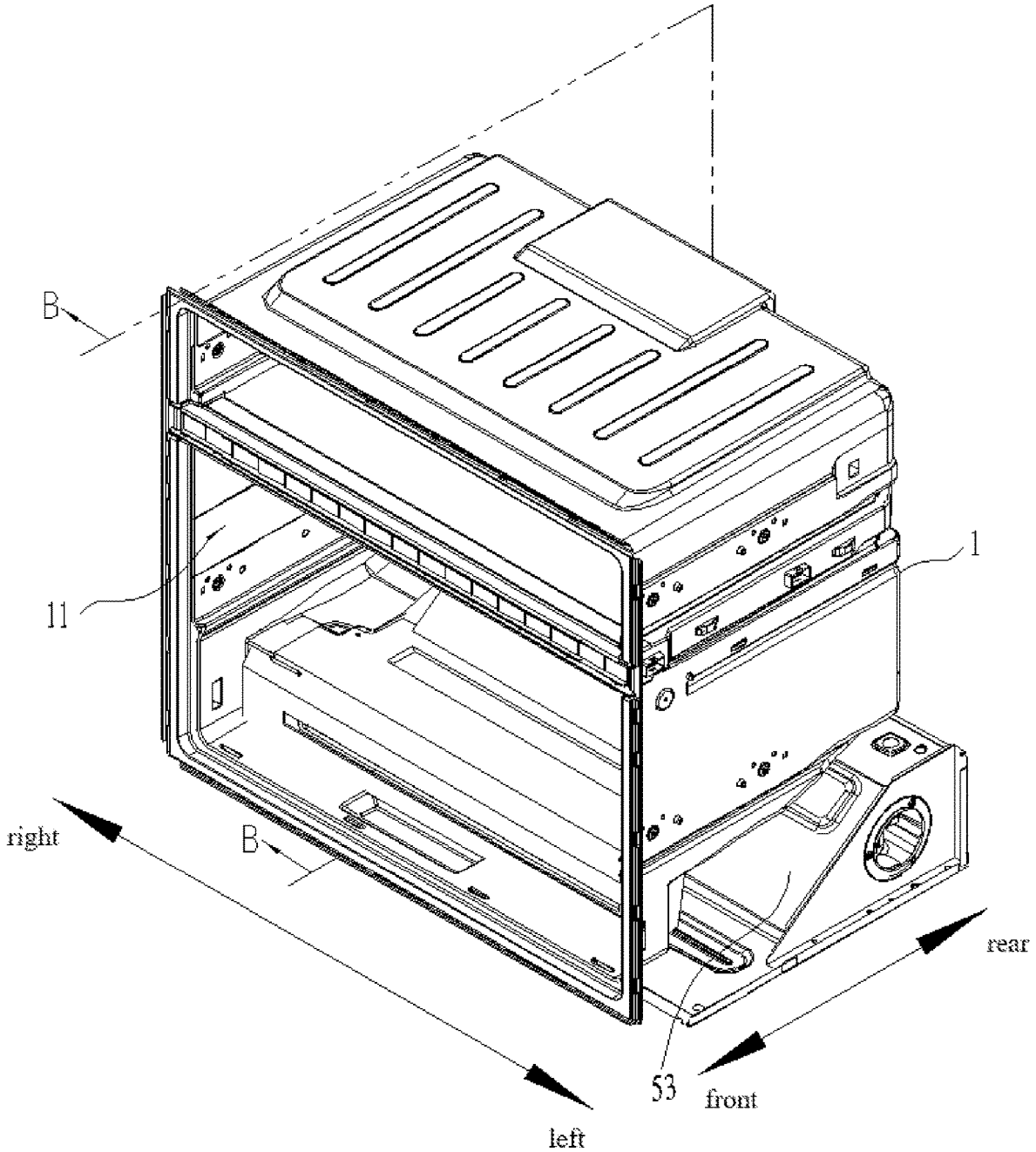
FIG. 3 is a rear upper isometric view of the bottom part structure shown in FIG. 1.
Figure 4:
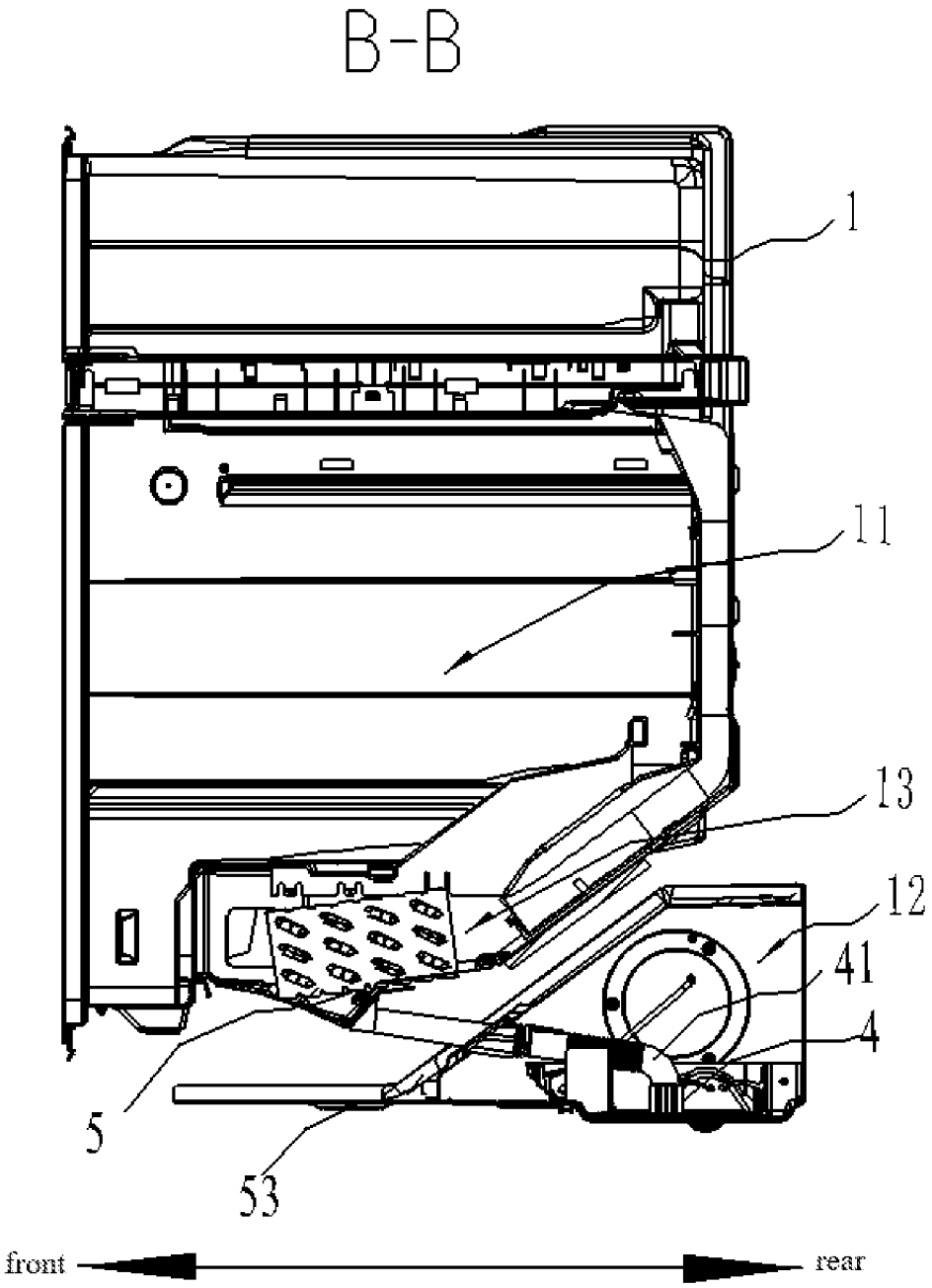
FIG. 4 is a sectional view of the bottom part structure taken along line B-B shown in FIG. 3.

FIG. 1 is a rear upper isometric view of a bottom part structure of a refrigerator having an inclined drain pipe disposed at a lower portion of the refrigerator according to some embodiments of the application; FIG. 2 is a sectional view of the bottom part structure taken along line A-A in FIG. 1; FIG. 3 is a rear upper isometric view of the bottom part structure shown in FIG. 1; FIG. 4 is a sectional view of the bottom part structure taken along line B-B shown in FIG. 3.

As shown in FIGS. 1 to 4, in some embodiments of this application, the refrigerator mainly comprises a cabinet 1, a compressor 2, an air duct component 3, an evaporation dish 4, and an evaporator 5.

The cabinet 1 defines two storage chambers 11, a heat dissipation machine compartment 12, and a refrigeration cavity 13. The storage chambers 11 are not limited to the two shown in the figures; it can be configured in other numbers according to needs, for example, one or more. When there is only one storage chamber 11, it can be a freezer, a variable temperature compartment, or a refrigerator compartment. When there are two or more storage chambers 11, multiple storage chambers 11 comprise at least one or several of freezer, variable temperature compartment, and refrigerator compartment. In implementing the technical scheme of this application, those skilled in the art can configure the number and functions of the storage chambers 11 as needed.

The cabinet 1 has the heat dissipation machine compartment 12 at a rear bottom portion thereof. In some embodiments, the refrigeration cavity 13 is formed in a bottom portion of the storage chamber 11 for arranging the evaporator. That is, the refrigeration cavity 13 can be arranged above the front of the heat dissipation machine compartment 12, while the heat dissipation machine compartment 12 formed below and behind the refrigeration cavity 13, thereby realizing a bottom-placed evaporator refrigerator. The refrigeration cavity 13 occupies a bottom area of an inner liner, thereby raising the storage chamber 11, reducing a bending degree of the user when accessing items in the storage chamber 11, and enhancing the user experience. The evaporator 5 is installed inside the refrigeration cavity 13, for providing cooling to an interior of the storage chamber 11.

The heat dissipation machine compartment 12 is divided by the air duct component 3 into a first heat dissipation chamber 121 and a second heat dissipation chamber 122, thereby dividing the space to arrange different components accordingly.

Figure 5:
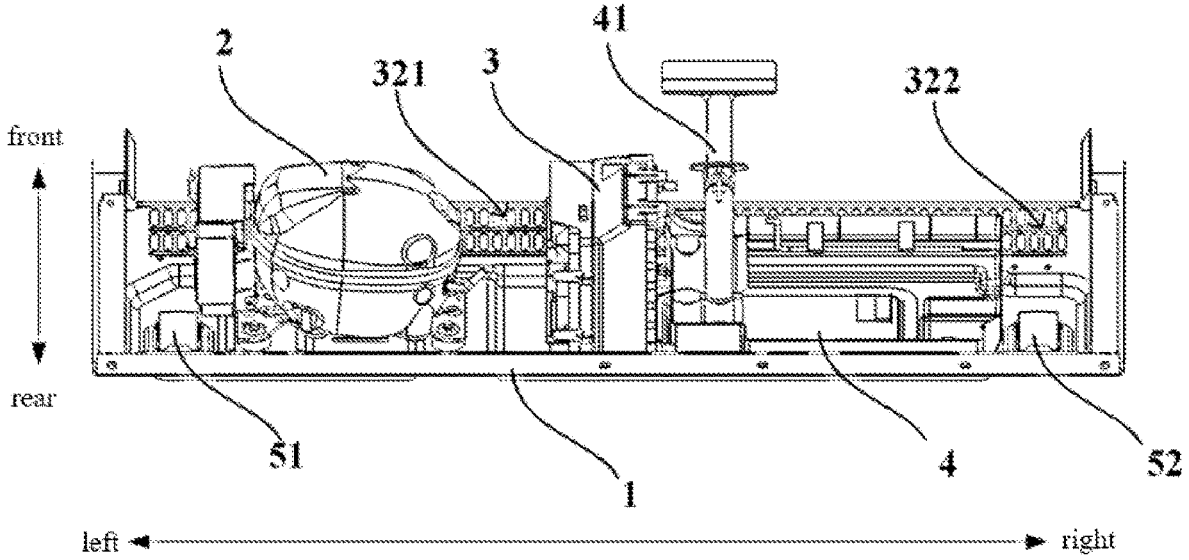
FIG. 5 is a schematic diagram showing main components distribution inside a heat dissipation machine compartment of the refrigerator according to some embodiments of the application.

FIG. 5 is a schematic diagram of main components distribution inside the heat dissipation machine compartment 12 of the refrigerator according to some embodiments of this application; from left to right along a transverse direction of the refrigerator, the compressor 2, air duct component 3, and evaporation dish 4 are sequentially arranged inside the heat dissipation machine compartment 12.

The air duct component 3 is located in the middle of the heat dissipation machine compartment 12, dividing the heat dissipation machine compartment 12 along the transverse direction of the cabinet l into a first heat dissipation chamber 121 and a second heat dissipation chamber 122, the air duct component 3 has a fan fixing structure on a side facing towards the first heat dissipation chamber 121, and a condenser fixing structure is arranged on a side facing towards the second heat dissipation chamber 122. The compressor 2 and the evaporation dish 4 are respectively arranged in the first heat dissipation chamber 121 and the second heat dissipation chamber 122.

The compressor 2 is located in the first heat dissipation chamber 121 and is connected to the condenser (not shown in FIG. 5 due to being covered by the air duct component 3) through the refrigeration piping (not shown).

The evaporation dish 4 is arranged inside the beat dissipation machine compartment 12, specifically it can be installed in the second heat dissipation chamber 122, to collect water discharged by the drain pipe 41 connected to the refrigeration cavity 13. The drain pipe 41 extends from a bottom portion of the refrigeration cavity 13 to the heat dissipation machine compartment 12, meaning an upper end of the drain pipe 41 connects to the bottom portion of the refrigeration cavity 13, and a lower end of the drain pipe 41 extends to the evaporation dish 4. The drain pipe 41 is used to discharge the refrigerator's defrost water into the evaporation dish 4, the evaporation dish 4 is utilized to evaporate the water into the ambient air.

The installation method of the drain pipe 41 is set from the bottom portion of the refrigeration cavity 13, inclined downwards from front to back, passing through the front wall 53 of the heat dissipation machine compartment 12, and further extending to the evaporation dish 4, thereby draining the defrost water from the refrigeration cavity 13 to the evaporation dish 4.

A bottom plate of the heat dissipation machine compartment 12 has a heat intake vent 321 and a heat exhaust vent 322 in front of the first heat dissipation chamber 121 and the second heat dissipation chamber 122 respectively. The ambient air at the bottom side of the refrigerator enters into the heat dissipation machine compartment 12 through the heat intake vent 321, firstly exchanges heat with the compressor 2, then after passing through the heat dissipation fan and condenser, accelerates the evaporation of water inside the evaporation dish 4, and finally is discharged back under the refrigerator through the beat exhaust vent 322. The beat dissipation airflow is smooth, thereby enhancing the cooling efficiency of each component. A separator is further disposed on the underside of the refrigerator's bottom plate for separating the heat intake vent 321 and the heat exhaust vent 322, thereby preventing the air heated by dissipation from being re-intaken.

The bottom plate of the heat dissipation machine compartment 12 can also be referred to as a compressor support plate, a first roller 51 and a second roller 52 can be disposed on left and right sides of the compressor support plate, respectively That is, the bottom plate of the heat dissipation machine compartment 12 has the first roller 51 set on a side of the compressor 2 opposite to the air duct component 3, the bottom plate of the heat dissipation machine compartment 12 has the second roller 52 set on a side of the evaporation dish 4 opposite to the air duct component 3. The first roller 51 and the second roller 52 are used for rolling when moving the refrigerator.

Figure 6:
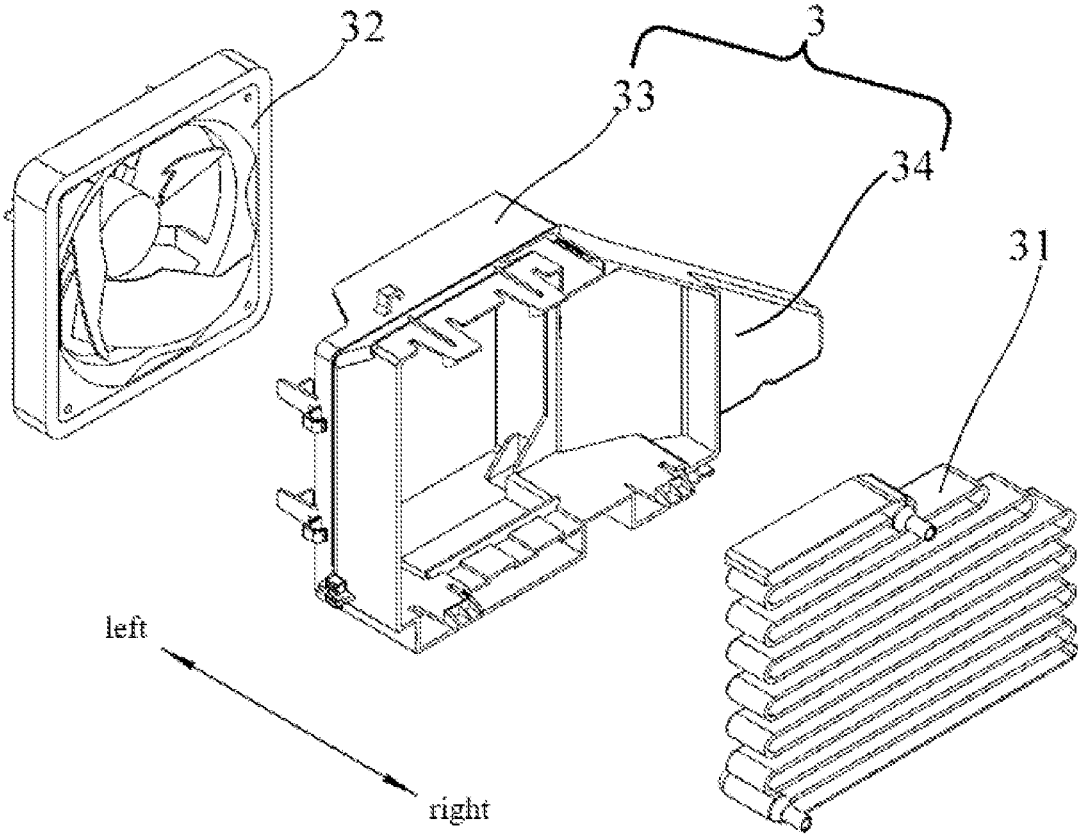
FIG. 6 is an exploded structural diagram of an assembly structure between an air duct component, a heat dissipation fan, and a condenser in the refrigerator according to some embodiments of the application.

FIG. 6 is an exploded structural diagram of an assembly structure of the air duct component 3 with the heat dissipation fan 32 and condenser 31 in the refrigerator according to some embodiments of the application. The air duct component 3, together with the heat dissipation fan 32 and condenser 31, form a pre-assembled unit, for creating a duct structure for the heat dissipation airflow, which allows the airflow to pass entirely through the condenser 31. This improves heat dissipation efficiency while making the structure more compact and simplifying the assembly process.

The air duct component 3 is placed in the middle of the heat dissipation machine compartment 12, dividing the heat dissipation machine compartment 12 along the transverse direction of the cabinet 1 into the first heat dissipation chamber 121 and the second heat dissipation chamber 122. The air duct component 3 has the fan fixing structure on the side facing towards the first heat dissipation chamber 121 and the condenser fixing structure on the side facing towards the second heat dissipation chamber 122. That is, the fan fixing structure faces towards the side of the compressor 2, and the condenser fixing structure faces towards the side of the evaporation dish 4. The air duct component 3 is arranged in a front-to-back direction. The fan fixing structure and the condenser fixing structure can both be snap-fit structures that snap onto a housing of the heat dissipation fan 32 and the condenser 31, respectively.

The heat dissipation fan 32 is mounted on the fan fixing structure to facilitate the formation of a heat dissipation airflow that enters from an exterior of the cabinet and passes through the first heat dissipation chamber 121 and the second heat dissipation chamber 122 until discharging from the cabinet. The condenser 31 is mounted on the condenser fixing structure and is cooled by the heat dissipation airflow. The airflow sequentially passes through the compressor 2, the condenser 31, and the evaporation dish 4, thereby dissipating heat from each component in turn, and improving heat dissipation efficiency.

The fan fixing structure and the condenser fixing structure are arranged on both sides of the air duct component 3 to install the heat dissipation fan 32 and the condenser 31, thereby forming an integrated duct structure that reduces the space occupied by the heat dissipation fan 32 and the condenser 31. The arrangement of components inside the heat dissipation machine compartment is more compact, thereby providing more space for the compressor 2 and the evaporation dish 4, which is beneficial for enhancing heat dissipation efficiency. Compared to existing technologies that place the condenser above the evaporation dish 4, the structure of this embodiment reduces the vertical dimension of the heat dissipation machine compartment 12.

The air duct component 3 comprises a bracket body 33 and a wind deflector 34. The bracket body 33 is of a square cylindrical shape, and extending along the transverse direction of the cabinet 1. i.e., extending along a left-and-right direction. The cylindrical shape of the bracket body allows the heat dissipation airflow to pass through. The wind deflector 34 extends from the front end of the bracket body 33 to block the front areas of the first heat dissipation chamber 121 and the second heat dissipation chamber 122, preventing the recirculation of the heat dissipation airflow and allowing airflow to pass only through the interior of the bracket body 33.

The condenser 31 can preferably use a microchannel condenser, which saves space occupied by the condenser 31 and facilitates compatibility with the bracket body 33. The gaps between the microchannels of the microchannel condenser are in a same direction of the heat dissipation airflow, thereby requiring all the heat dissipation airflow to pass through the condenser 31, and improving the heat exchange efficiency.

During assembly, the condenser 31, the heat dissipation fan 32, and the air duct component 3 can be pre-assembled into a pre-assembled unit, which is then installed as a whole inside the cabinet 1.

Figure 7:
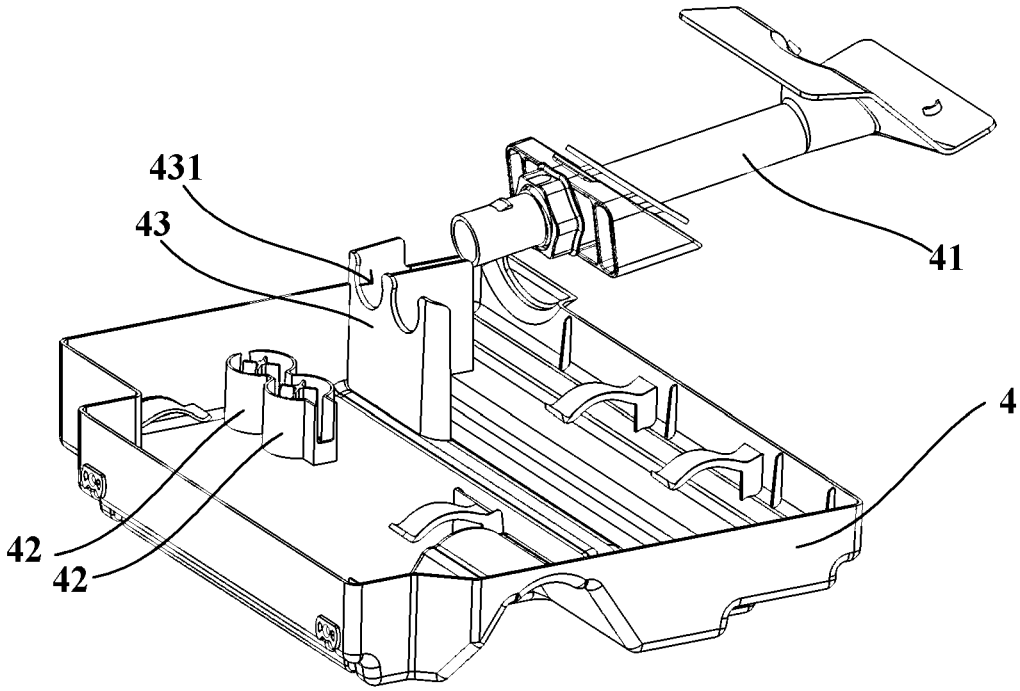
FIG. 7 is a structural diagram of an evaporation dish in the refrigerator according to some embodiments of the application.

FIG. 7 is a structural diagram of the evaporation dish 4 in the refrigerator according to some embodiments of the application. The evaporation dish 4 is arranged inside the heat dissipation machine compartment 12, and a plurality of connecting parts 42 are arranged along the transverse width of the refrigerator. These connecting parts 42 are adapted to the positions of drain pipes 41 of different widths of the cabinet 1, thus allowing one of the multiple connecting parts 42, which directly aligns with the position of the drain pipe 41, to connect with the drain pipe 41, thereby enabling the evaporation dish 4 to collect water discharged from the drain pipe 41.

In front of the multiple connecting parts 42 of the evaporation dish 4, there is an anti-insertion baffle 43. The anti-insertion baffle 43 is provided with a plurality of positioning slots 431 corresponding to the multiple connecting parts 42 in a one-to-one relationship. The positioning slots 431 are used to fix the drain pipe 41, for preventing the drain pipe 41 from shaking on one hand, and enhancing the support strength of the drain pipe 41 on the other.

FIG. 7 shows two connecting parts 42, designed to adapt to two different width specifications of the cabinet 1. In practice, those skilled in the art can set the number of connecting parts 42 as needed, adapting to box bodies with different specifications through the connecting parts 42.

The projection of the drain pipe 41 on the bottom plate of the heat dissipation machine compartment 12 is a straight line along the front-to-back direction of the cabinet 1, and the drain pipe 41 is set to slope downwards from front to back, thereby relying on gravity to guide water to the evaporation dish 4. The position of the drain pipe 41 relative to the cabinet 1 is determined by the structure of the refrigeration cavity 13 and the position of the drainage outlet of the refrigeration cavity 13. To facilitate drainage, the drain pipe 41 is required to be as short as possible and close to a transverse center position of the cabinet 1. For smooth drainage of the drain pipe 41, a drainage angle of the drain pipe 41 is required to be greater than or equal to 5 degrees.

Due to a relative position of the refrigeration cavity 13 and the heat dissipation machine compartment 12, to save space, the front wall 53 of the heat dissipation machine compartment 12 extends upwards inclined from the middle of the bottom plate of the cabinet 1 from front to back; and since the drain pipe 41 is set to slope downwards from front to back, a small angle is formed between the drain pipe 41 and a plane where the front wall 53 of the heat dissipation machine compartment 12 is located, thereby the drain pipe 41 is difficult to secure. To solve this problem, this embodiment adds a water pipe securing member 44.

Figure 8:
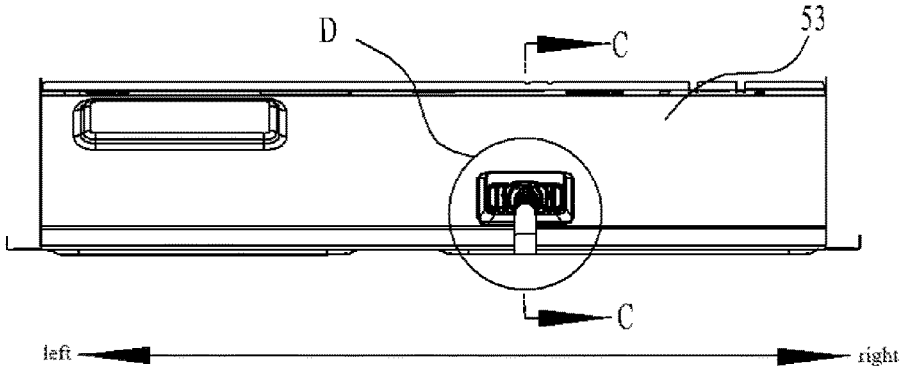
FIG. 8 is a compatibility structure diagram between the drain pipe and a front wall of the heat dissipation machine compartment in the refrigerator according to some embodiments of the application.
Figure 9:
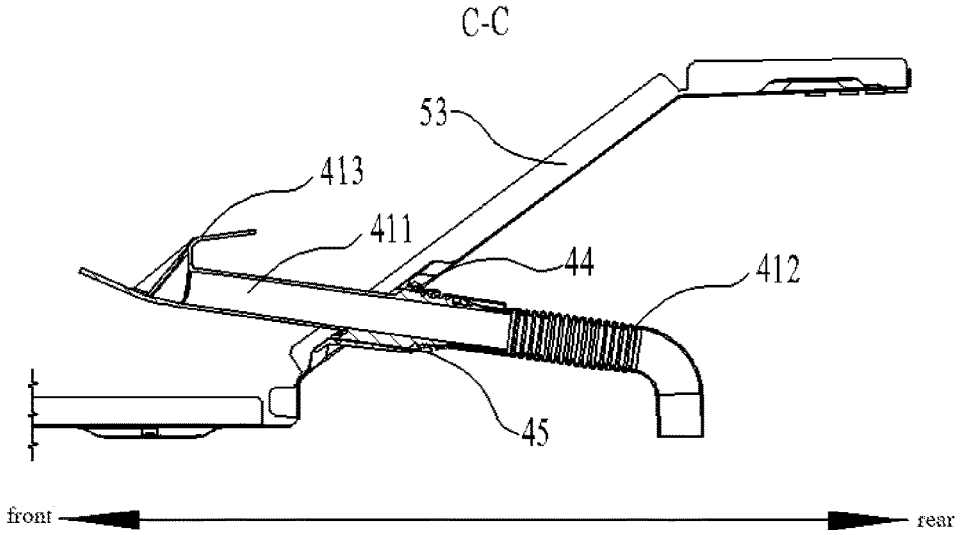
FIG. 9 is a sectional view of the compatibility structure taken along line C-C shown in FIG. 8.
Figure 10:
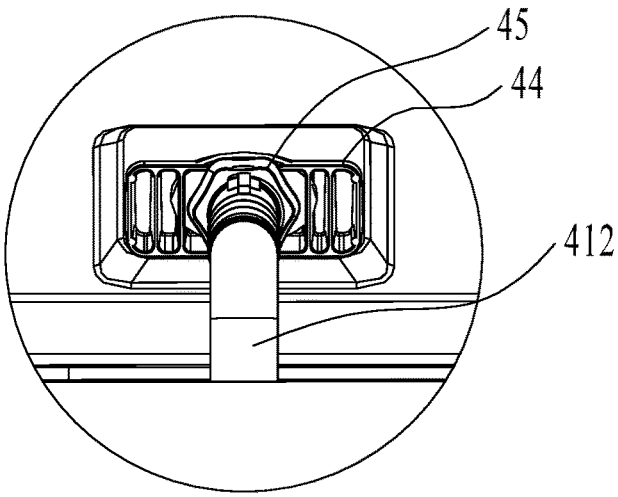
FIG. 10 is a partial enlarged view of the compatibility structure in an area D shown in FIG. 9.
Figure 11:
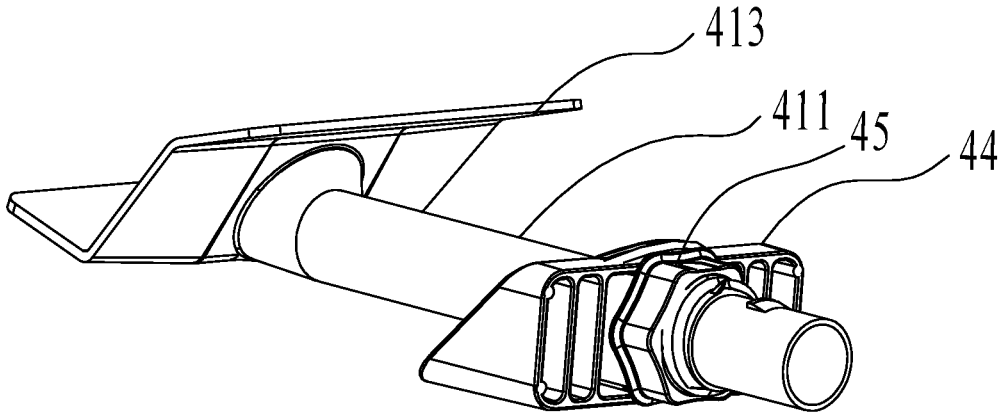
FIG. 11 is a schematic view of the compatibility structure between the drain pipe and a water pipe securing member from one angle in the refrigerator according to some embodiments of the application.
Figure 12:
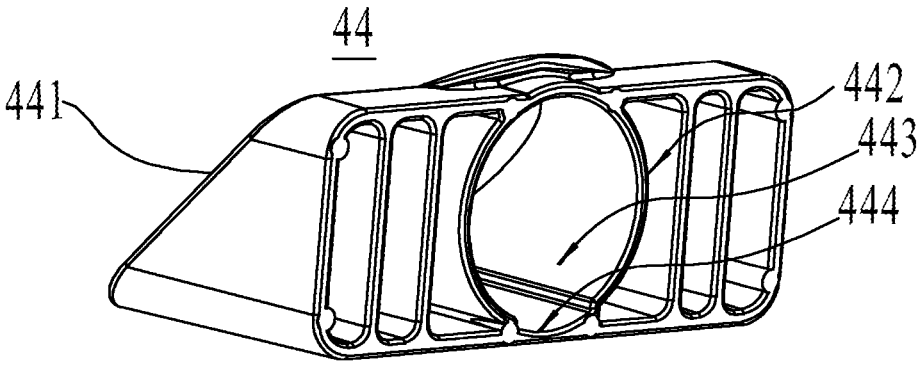
FIG. 12 is a schematic view of the water pipe securing member in FIG. 11.
Figure 13:
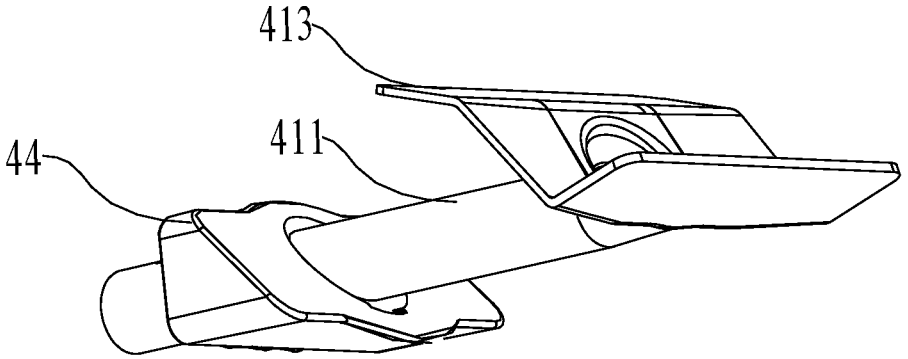
FIG. 13 is a schematic view of the compatibility structure between the drain pipe and the water pipe securing member from another angle according to some embodiments of the application.
Figure 14:
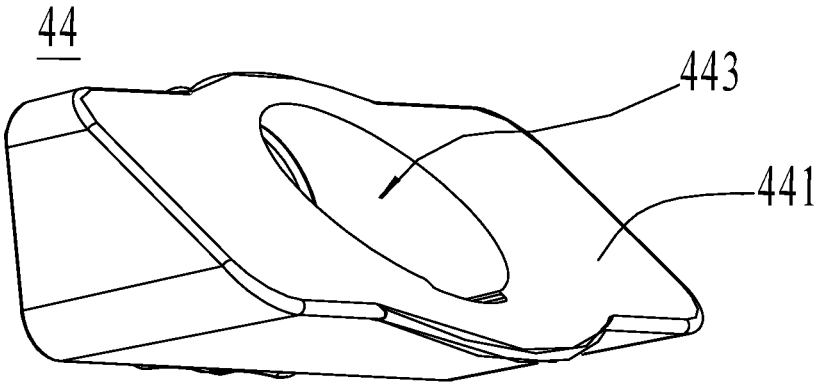
FIG. 14 is a schematic view of the water pipe securing member in FIG. 13.

FIG. 8 shows the compatibility structure diagram between the drain pipe 41 and the front wall 53 of the heat dissipation machine compartment 12 in the refrigerator according to some embodiments of the application, FIG. 9 is a cross-sectional view of the compatibility structure taken along line C-C shown in FIG. 8, and FIG. 10 is a partial enlarged view of the compatibility structure in an area D shown in FIG. 9; FIG. 11 is a schematic view of the compatibility structure between the drain pipe 41 and the water pipe securing member 44 from one angle in the refrigerator according to some embodiments of the application; FIG. 12 is a schematic view of the water pipe securing member 44 in FIG. 11; FIG. 13 is a schematic view of the compatibility structure between the drain pipe 41 and the water pipe securing member 44 from another angle according to some embodiments of the application; FIG. 14 is a schematic view of the water pipe securing member 44 in FIG. 13. The front wall 53 of the heat dissipation machine compartment 12 is omitted in FIGS. 11-13.

The front wall 53 of the heat dissipation machine compartment 12, also known as the bottom steel plate, encloses the refrigeration compartment 12. A foaming space is formed between the front wall 53 of the heat dissipation machine compartment 12 and the wall of the refrigeration cavity 13, filled with foaming material to create an insulation layer. If the fixation is not reliable, the position where the drain pipe 41 passes through the front wall 53 of the heat dissipation machine compartment 12 is prone to leakage of foaming material into the beat dissipation machine compartment 12 during the filling process.

The water pipe securing member 44 is positioned where the drain pipe 41 passes through the front wall 53, used for securing the drain pipe 41. The water pipe securing member 44 has a first securing face 441, which abuts against the front wall 53 of the heat dissipation machine compartment 12. The first securing face 441 can be the front surface of the water pipe securing member 44, generally abutting against the front wall 53, forming a surface contact, and avoiding problems caused by the acute angle setting that lead to poor contact.

The front wall 53 of the heat dissipation machine compartment 12 has a front wall through-hole where the drain pipe 41 passes through. The shape of the front wall through-hole matches the cross-sectional shape of the drain pipe 41 on the plane where the front wall 53 of the heat dissipation machine compartment 12 is located. For example, for a circular pipe-shaped drain pipe 41, the shape of the front wall through-hole is elliptical. The shape of the front wall through-hole matches the cross-section shape of the drain pipe 41, thereby reducing the gap between the drain pipe 41 and the front wall 53.

The water pipe securing member 44 features a perforating hole 443 for the drain pipe 41 to pass through, where a shape of an opening of the perforating hole 443 formed on the first securing face 441 matches that of the front wall through-hole. That is, if the shape of the front wall through-hole is elliptical, the shape of the opening of the perforating hole 443 formed on the first securing face 441 is also elliptical.

The water pipe securing member 44 has a second fixing surface 442 on a side opposite to the first securing face 441, and the second fixing surface 442 is perpendicular to an axial direction of the drain pipe 41, thereby making a shape of an opening of the perforating hole 443 formed on the second fixing surface 442 consistent with a cross-section of the drain pipe 41. The second fixing surface 442 being perpendicular to the axial direction of the drain pipe 41 allows the drain pipe 41 to pass through the second fixing surface 442 perpendicularly, so that the fastening mechanism of the drain pipe 41 can contact the second fixing surface 442 of the water pipe securing member 44 in a face-contact manner, thereby preventing problems of poor contact. For example, for a cylindrical drain pipe 41, the shape of the opening of the perforating hole 443 formed on the second fixing surface 442 is also circular.

The drain pipe 41 comprises a first section 411 and a second section 412. A first end of the first section 411 connects to the bottom portion of the refrigeration cavity 13, and a second end of the first section 411 passes through the perforating hole 443 and defines a connecting structure on an outer perimeter thereof. The first end of the first section 411 can be equipped with a support plate 413, whose shape matches a shape of the bottom portion of the refrigeration cavity 13 and contacts a bottom wall of the refrigeration cavity 13, thereby preventing the foaming material from overflowing into the refrigeration cavity 13 and clogging the drainage outlet during the foaming process.

The second section 412 connects to the second end of the first section 411 and extends to the evaporation dish 4. The first section 411 is a rigid tube to prevent compression by the foaming material, and at least a part of the second section 412 is a corrugated tube, thereby providing some flexibility for adjusting a length and position.

The connecting structure can be a threaded structure. Additionally, the refrigerator can be provided with a fixing nut 45, which is detachably connected to the threaded structure, and an end of the fixing nut 45 is abutting against the second fixing surface 442 to secure the drain pipe 41 and the water pipe securing member 44.

The water pipe securing member 44 improves a tightening surface of the fixing nut 45, thereby making the fixing nut 45 easy to screw in, it's convenient to operate and reliable in performance.

The first section 411 defines at least one positioning rib (not shown) along the axial direction on a radial outer circumference of a segment through the perforating hole 443; the perforating hole 443 forms a positioning slot 444 on the radial outer circumference that matches the positioning rib, using the combination of the positioning rib and positioning slot 444 to limit the position of the first section, thereby preventing the drain pipe 41 from rotating.

An opening of the perforating hole 443 formed on the first securing face 441 is located in the middle of the first securing face 441; the first securing face 441 has spaces around the opening that abut the front wall 53 of the heat dissipation machine compartment 12, thereby sealing the gap around the drain pipe 41 and preventing leakage.

The front wall 53 of the heat dissipation machine compartment 12 defines a protrusion in an area corresponding to the water pipe securing member 44, the protrusion is slightly protruding towards the direction of the refrigeration cavity 13, further preventing leakage around the drain pipe 41. The water pipe securing member 44 is embedded in a recess behind the protrusion, which also facilitates the installation of the water pipe securing member 44.

So far, it should be appreciated by those skilled in the art that while various exemplary embodiments of the application have been shown and described in detail herein, many other variations or modifications which are consistent with the principles of this application may be determined or derived directly from the disclosure of the present application without departing from the spirit and scope of the application. Accordingly, the scope of the application should be understood and interpreted to cover all such other variations or modifications.

What is claimed is:

1. A refrigerator having an inclined drain pipe disposed at a lower portion of the refrigerator, comprising:

a cabinet, defining a storage chamber therein, a refrigeration cavity for arranging an evaporator formed in a bottom portion of the storage chamber, and the cabinet having a heat dissipation machine compartment at a rear bottom portion of the refrigeration cavity, a front wall of the heat dissipation machine compartment extending from a middle of a bottom plate of the cabinet obliquely upwards along a front-to-back direction;

an evaporation dish, arranged in the heat dissipation machine compartment;

the inclined drain pipe, extending obliquely downwards from a bottom portion of the refrigeration cavity along the front-to-back direction, passing through the front wall of the heat dissipation machine compartment and further extending to the evaporation dish, thereby draining defrost water from the refrigeration cavity to the evaporation dish;

a water pipe securing member, arranged at a position where the inclined drain pipe passes through the front wall, and used for securing the inclined drain pipe, the water pipe securing member having a first securing face, which is used to abut the front wall of the heat dissipation machine compartment;

wherein the water pipe securing member is of an integrative construction and disposed in the heat dissipation machine compartment, and the first securing face is a front surface of the water pipe securing member, the water pipe securing member has a perforating hole for the inclined drain pipe to pass through, a shape of an opening of the perforating hole formed on the first securing face is consistent with that of the front wall through-hole.

2. The refrigerator having an inclined drain pipe disposed at a lower portion of the refrigerator according to claim 1, wherein the front wall of the heat dissipation machine compartment has a front wall through-hole where the inclined drain pipe passes through, a shape of the front wall through-hole is consistent with a cross-sectional shape of the inclined drain pipe on a plane where the front wall of the heat dissipation machine compartment is located.

3. The refrigerator having an inclined drain pipe disposed at a lower portion of the refrigerator according to claim 2, wherein the water pipe securing member has a second fixing surface on a side opposite to the first securing face, the second fixing surface is perpendicular to an axial direction of the inclined drain pipe, thereby making a shape of an opening of the perforating hole formed on the second fixing surface consistent with a cross-section of the inclined drain pipe.

4. The refrigerator having an inclined drain pipe disposed at a lower portion of the refrigerator according to claim 3, wherein the inclined drain pipe comprises:

a first section, one end of the first section is connected to the bottom portion of the refrigeration cavity, the other end of the first section passes through the perforating hole and defines a connecting structure on an outer perimeter thereof;

a second section, connected to the other end of the first section and extending to the evaporation dish.

5. The refrigerator having an inclined drain pipe disposed at a lower portion of the refrigerator according to claim 4, wherein the connecting structure comprises a threaded structure, and the refrigerator further comprises a fixing nut, the fixing nut is detachably connected to the threaded structure, an end of the fixing nut is abutting against the second fixing surface, to secure the inclined drain pipe and the water pipe securing member.

6. The refrigerator having an inclined drain pipe disposed at a lower portion of the refrigerator according to claim 4, wherein the first section is a rigid tube; at least a part of the second section is a corrugated tube; and/or an inclination angle of the inclined drain pipe is greater than or equal to 5 degrees.

7. The refrigerator having an inclined drain pipe disposed at a lower portion of the refrigerator according to claim 4, wherein the first section defines at least one positioning rib along the axial direction on a radial outer circumference of a segment through the perforating hole;

the perforating hole forms a positioning slot on the radial outer circumference that matches the positioning rib, to limit the position of the first section through the combination of the positioning rib and the positioning slot.

8. The refrigerator having an inclined drain pipe disposed at a lower portion of the refrigerator according to claim 2, wherein an opening of the perforating hole formed on the first securing face is located in the middle of the first securing face; the first securing face has spaces around the opening that abut the front wall of the heat dissipation machine compartment.

9. The refrigerator having an inclined drain pipe disposed at a lower portion of the refrigerator according to claim 8, wherein the front wall of the heat dissipation machine compartment defines a protrusion in an area corresponding to the water pipe securing member; and the water pipe securing member is embedded in a recess behind the protrusion.

10. The refrigerator having an inclined drain pipe disposed at a lower portion of the refrigerator according to claim 1, further comprising:

an air duct component, arranged at a middle area of the heat dissipation machine compartment along a transverse direction, dividing the heat dissipation machine compartment along the transverse direction of the cabinet into a first heat dissipation chamber and a second heat dissipation chamber, the air duct component has a heat dissipation fan mounted on a side facing towards the first heat dissipation chamber, and a condenser mounted on a side facing towards the second heat dissipation chamber;

a compressor, installed in the first heat dissipation chamber;

the evaporation dish installed in the second heat dissipation chamber.

11. A refrigerator having an inclined drain pipe disposed at a lower portion of the refrigerator, comprising:

a cabinet, defining a storage chamber therein, a refrigeration cavity for arranging an evaporator formed in a bottom portion of the storage chamber, and the cabinet having a heat dissipation machine compartment at a rear bottom portion of the refrigeration cavity, a front wall of the heat dissipation machine compartment extending from a middle of a bottom plate of the cabinet obliquely upwards along a front-to-back direction;

an evaporation dish, arranged in the heat dissipation machine compartment;

the inclined drain pipe, extending obliquely downwards from a bottom portion of the refrigeration cavity along the front-to-back direction, passing through the front wall of the heat dissipation machine compartment and further extending to the evaporation dish, thereby draining defrost water from the refrigeration cavity to the evaporation dish;

a water pipe securing member, arranged at a position where the inclined drain pipe passes through the front wall, and used for securing the inclined drain pipe, the water pipe securing member having a first securing face, which is used to abut the front wall of the heat dissipation machine compartment;

wherein the front wall of the heat dissipation machine compartment has a front wall through-hole where the inclined drain pipe passes through, a shape of the front wall through-hole is consistent with a cross-sectional shape of the inclined drain pipe on a plane where the front wall of the heat dissipation machine compartment is located; and the water pipe securing member has a perforating hole for the inclined drain pipe to pass through, a shape of an opening of the perforating hole formed on the first securing face is consistent with that of the front wall through-hole.

* * * * *